United States Patent [19]

McGee et al.

[11] 4,062,133

[45] Dec. 13, 1977

[54] BOOT WITH HINGED UPPER

[75] Inventors: Charles Donald McGee; Charles S. French; David T. Robran, all of Ketchum, Idaho

[73] Assignee: Scott USA, Inc., Sun Valley, Idaho

[21] Appl. No.: 723,022

[22] Filed: Sept. 13, 1976

[51] Int. Cl.[2] ..... A43B 5/04

[52] U.S. Cl. ..... 36/120

[58] Field of Search ..... 36/109, 120, 121, 4, 36/1.5, 2 R, 25 R, 32 R

[56] References Cited

U.S. PATENT DOCUMENTS

| | | | |
|---|---|---|---|
| 808,666 | 1/1906 | Linthicum | 36/109 |
| 2,724,676 | 11/1955 | Randall et al. | 36/4 |
| 3,067,531 | 12/1962 | Scott et al. | 36/120 |
| 3,698,106 | 10/1972 | Rieker | 36/121 |
| 3,945,134 | 3/1976 | Ramer | 36/120 |

*Primary Examiner*—Patrick D. Lawson

*Attorney, Agent, or Firm*—Wegner, Stellman, McCord, Wiles & Wood

[57] ABSTRACT

A motorcycle boot has an upper wrap-around shell, closed by a buckle and strap, which overlaps a lower vamp shell having a plurality of forward and rear tapering fingers which extend into the upper shell to allow hinging movement of the upper shell. Flexible liners are inserted into the vamp to custom fit the vamp shell to a wearer's foot. An interconnecting hinge assembly includes a pivot pin, journalled in the upper shell, and slidably mounted within a slotted plate attached to the lower shell, to allow the upper shell to pivot forwardly and rearwardly and rock sideways. The base of the lower shell, with a steel plate embedded in the instep arch, is covered by a replaceable sole attached by adhesive which forms a rupturable seal. To waterproof the boot, a flexible cylindrical liner is sealed to the lower vamp and extends through the upper shell, with the liner top being folded down and externally attached to the upper shell.

23 Claims, 8 Drawing Figures

Fig. 4.
Fig. 5.
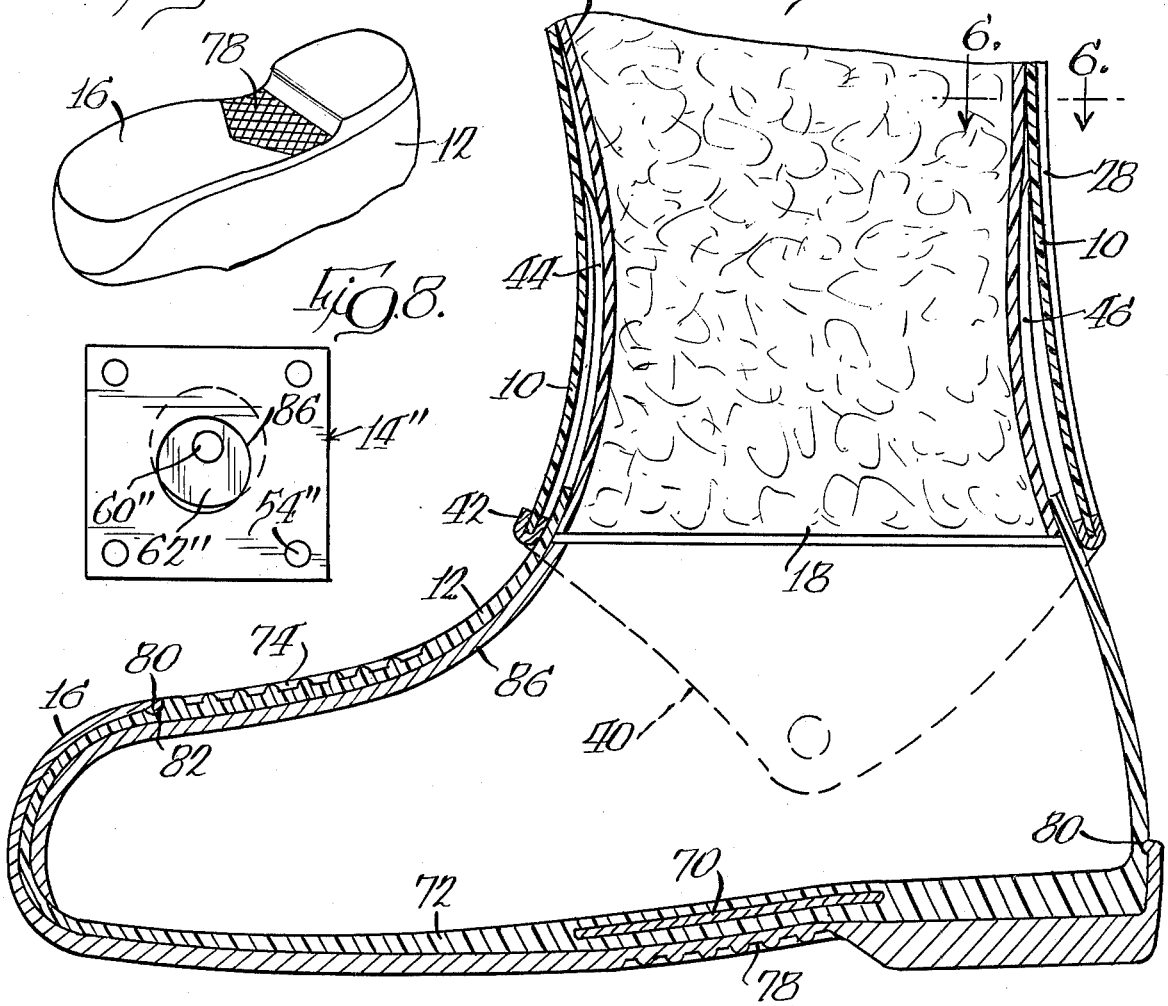
Fig. 8.
Fig. 7.
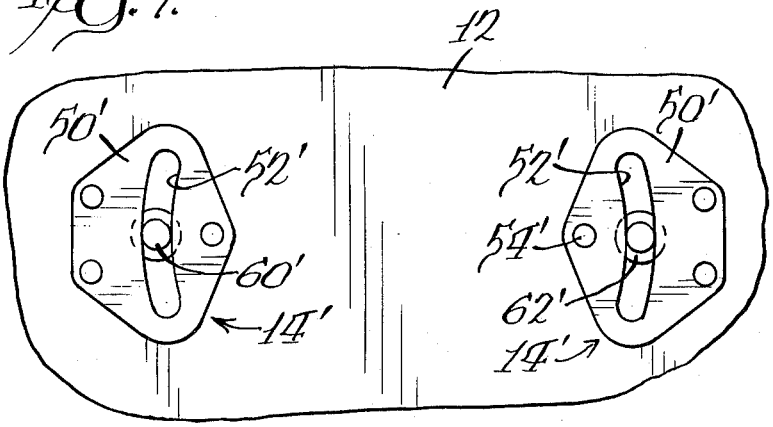
Fig. 6.
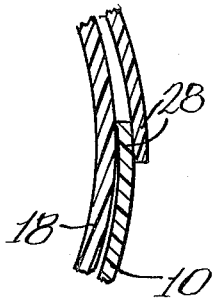

BOOT WITH HINGED UPPER

BACKGROUND OF THE INVENTION

This invention relates to a boot having a hinged upper shell.

Boots used for motorcycle racing and the like have traditionally used flexible leather uppers of sufficient thickness to protect the lower leg against airborne rocks while still allowing some flexibility of movement and feel in the lower foot region. Ski boot technology, which offers potential advantages of increased protection and durability, has found limited use in motorcycle boots because of numerous unsolved problems.

To allow relatively free hinging movement of the upper shell relative to the lower vamp shell, the front and rear edges of both the upper shell and the vamp shell have been separated apart from the other to allow clearance for the upper shell as it moves forward and rearward. A less rigid material is located in the front and rear clearance gaps to enclose the shell and provide protection. However, this less rigid material has not provided the same degree of protection against flying rocks, nor has it adequately waterproofed the boot.

While ski-type boots are known which allow rocking sideways movement of an uppershell relative to a lower shell, in addition to pivoting forward and rearward movement, the hinge assembly has had externally mounted or externally accessible critical parts which thus are exposed to mud, flying peebles and other adverse conditions. Also, the complexity of prior hinge assemblies has increased the possibility of maintenance problems and jamming.

Another problem is that the sole of a motorcycle boot must have some resiliency and flexibility to provide adequate grip, which characteristics are not present in a vamp shell formed of a rigid plastic material. However, the flexible sole found on traditional motorcycle boots wears quickly when the boot is used for motorcycle racing, and greatly limits the life of the boot. In addition, a vamp shell of rigid plastic material limits the extent to which a wearer can "feel" the motorcycle shift lever and can respond to motorcycle and road conditions. In addition, even the rigid plastic material found in ski boots can be chewed up by the spiked surface of the motorcycle peg against which a motorcycle racer is continually placing his foot.

SUMMARY OF THE INVENTION

In accordance with the present invention, an improved boot for motorcycle use and the like has upper and lower shells formed of a relatively rigid plastic material, while eliminating the disadvantages previously found in boots of this type. The upper shell overlaps the entire foot receiving opening of the lower vamp shell for maximum protection, with the shells having a unique configuration which does not hinder the hinging movement of the upper shell relative to the lower shell. The hinge assembly which interconnects the shells is protectively located within the overlapping region between the shells, and consists of a uniquely simple hinge and slide mechanism. The mechanism is mounted within a pocket in the vamp shell for increased waterproof protection.

The lower vamp shell is formed of a relatively rigid plastic material covered by a unique replaceable sole formed of a flexible material and attached by a rupturable seal. The instep arch of the vamp shell has embeded therein a steel plate to prevent the spiked surface of the motorcycle peg from penetrating the base of the boot. The lower vamp shell is weakened by serrations located in the regions where increased "feel" is necessary. A flexible inner liner is sealed to the lower vamp and extends through the upper shell, with its top portion engaging the upper shell to increase rigidity thereof.

One subject of the present invention is the provision of a boot having an upper shell pivotally mounted to a lower shell and overlapping the entire lower shell for maximum foot protection while not hindering the pivoting action of the upper shell.

Another object of the present invention is a boot having a hinge assembly for interconnecting upper and lower shells and which is protected from external adverse conditions and allows pivoting and rocking motion of the upper and lower shells.

A further object of the present invention is the provision of a boot having a relatively rigid vamp shell covered by a replaceable relatively soft sole attached by a rupturable adhesive seal.

Other objects and features of the invention will be apparent from the following description and from the drawings. While illustrative embodiments of the invention are shown in the drawings and will be described in detail herein, the invention is susceptible of embodiment in many different forms and it should be understood that the present disclosure is to be considered as an exemplification of the principles of the invention and is not intended to limit the invention to the embodiments illustrated.

BRIEF DESCRIPTION OF THE DRAWINGS

FIG. 4 is a reduced perspective view of the base of the boot of FIG. 1;

FIG. 5 is an enlarged side sectional view of the boot, taken along lines 5—5 of FIG. 1;

FIG. 6 is a plan section of the overlapping rear edges of the upper shell, taken along lines 6—6 of FIG. 5;

FIG. 7 is an enlarged side view of a first embodiment of a modified interconnecting hinge assembly; and FIG. 8 is an enlarged side view of a second embodiment of a modified interconnecting hinge assembly.

DESCRIPTION OF THE PREFERRED EMBODIMENTS

Figure 1:
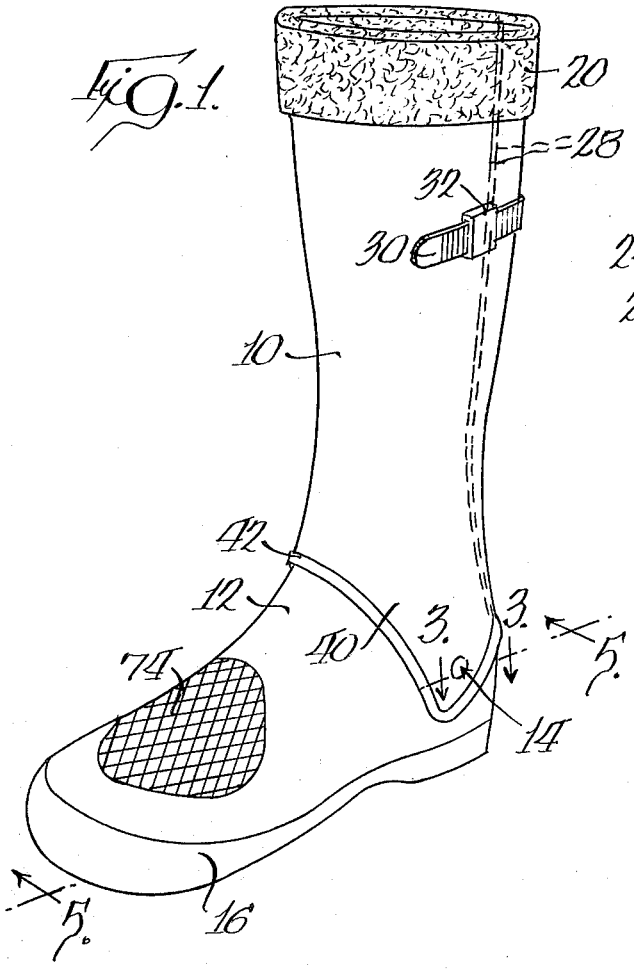
FIG. 1 is a perspective view of the boot with hinged upper shell.
Figure 2:
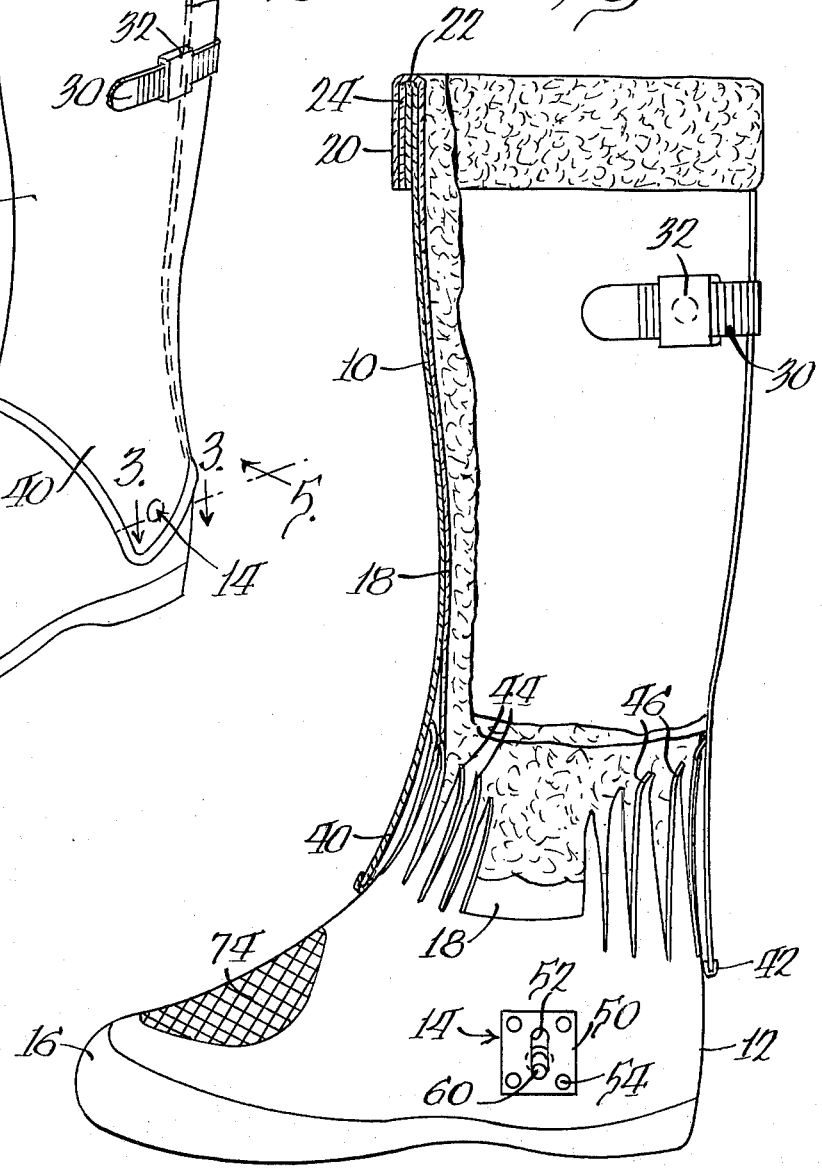
FIG. 2 is an enlarged side elevation, with the upper shell being partly in section, of the boot of FIG. 1.

Turning to FIGS. 1 and 2, a boot for motorcycle use and the like includes an upper shell 10 and a lower vamp shell 12, both formed of a relatively rigid plastic material, interconnected by a hinge assembly 14 located on each side of the boot. The base of the vamp shell 12 is covered by a replaceable sole 16 formed of a flexible, relatively resilient, rubber-like material which is attached to the shell 12 by an adhesive which forms a rupturable seal.

A cylindrical inner liner 18 of flexible, waterproof material, such as a closed cell neoprene foam, is hermetically sealed at its lower edge to the vamp shell 12 and extends through the upper shell 10. After a wearer's foot is inserted in the boot, the top 20 of the inner liner is folded down over the top edge of the upper shell 10. The outer surface of the upper shell 10 has an encircling band of attachment material 22 which detachably engages an encircling band 24 of attachment material located on the inner surface, when folded down, of the liner top 20. The attachment materials 22 and 24 may be detachable mating fabric hooks and loops, such as sold under the trademark VELCRO.

Upper shell 10 may be formed from a flat sheet of relatively rigid plastic material, such as ABS plastic, which is thermoformed into a cylindrical shape so as to have overlapping rear edges 28, see FIG. 6. When a wearer inserts his foot through the flexible inner liner 18, the upper shell 10 can expand circumferentially by sliding movement of the overlapping edges 28, so as to make it easier to insert the foot. After insertion, a strap 30 which is attached to one overlapping side is tightened by a buckle 32 attached to the other overlapping side in order to provide a more snug fit. After the strap and buckle are tightened, the top flap 20 is folded down and pressed inwardly so as to secure together the detachable fastening surfaces 22, 24. This increases the rigidity of the cylinder formed by the upper shell 10. The strap 30 and buckle 32 may take any conventional form, and are not illustrated in detail. Unlike a ski boot, the stresses tending to circumferentially expand the upper shell are slight, and the buckle or latch mechanism may be relatively simple.

Upper shell 10 has a lower region 40 which overlaps the entire upper portion of the lower vamp shell 12. A tubing or bead 42 of resilient material is permanently attached to the edge of the lower region 40 to form a seal with the vamp 12. Because the upper shell 10 extends over the entire upper portion of the lower shell 12, the boot provides maximum protection against flying objects. At the sides of the lower region 40, a pair of apertures receive portions of the hinge assembly 14. The foot defining opening of the lower vamp shell 12 includes a forward gator or flap formed by a plurality of elongated flexible fingers 44, and a rear gator or flap formed by a plurality of elongated flexible fingers 46.

Each of the fingers 44, 46 is molded as an integral part of the vamp shell 12, and each tapers in width and thickness towards an end which curves outwardly so as to press against the inner surface of the lower region 40. The tapering width fingers are a homolosine equal-area projection of a sphere onto a surface or plane. As the fingers are pushed inwardly, their sides abut to form a spherical surface. The foot fitting shape of the vamp opening generally does not allow exact abutting of all fingers to form a solid spherical surface, however, an approximation is formed which closes the gaps between the fingers so as to prevent penetration of the shell by most airborne objects. Along the sides of the vamp there are no fingers, although fingers can extend circumferentially around the entire foot defining opening if desired.

As the upper shell 10 pivots forwardly, for example, the rear fingers 46 are compressed towards each other by the inner surface of the lower region 40. The fingers 46 which are inwardly compressed form a segment of a sphere and generally abut along their length so as to form an almost solid spherical surface. In a similar manner, movement of the upper shell 10 rearwardly spreads the rear fingers, and compresses the front flap fingers 44 which resiliently yield so as to allow essentially free pivoting action of the upper shell while still closing the gaps so as to protect the leg. The inner liner 18 has its lower edge region sealed to the vamp below any of the fingers 44, 46 so as to prevent water entry in this region. The fingers 44, 46 are not attached to the inner lining 18 but are freely movable between the lining and the inner surface of the region 40. The inner liner is expandable to aid in allowing finger movement. If desired, the inner lining 18 can be reinforced in this region to decrease abrasion caused by the fingers against the lining.

For all practical purposes, the upper and lower shells form an armour-like shield which prevent penetration by flying objects, while still allowing free flexing of the upper shell. This desirable feature is accomplished with a vamp molded as a single integral unit and out of a relatively rigid plastic material. The forward and rear flaps could be separately formed and attached to the vamp, allowing use of a wide variety of shapes and materials, but at increased cost and complexity. For example, a bellows-like gator could be used. Or, the fingers 44, 46 could be formed of widths greater than spacing therebetween, with the fingers being elongated plates which overlap so that compression thereagainst would cause adjacent fingers to slide further behind the next finger.

Figure 3:
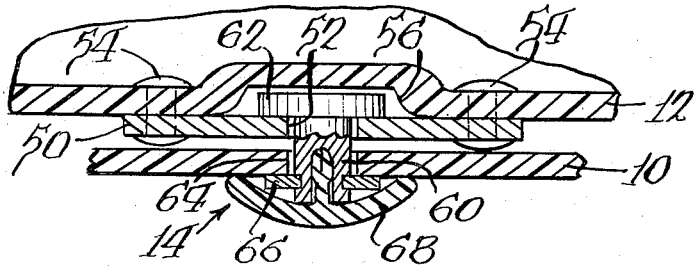
FIG. 3 is a sectional view of the interconnecting hinge assembly, taken along lines 3—3 of FIG. 1.

Hinge assembly 14, seen best in FIGS. 2 and 3, allows forward and rearward pivoting movement, and sideways rocking movement, of the upper shell 10. The assembly includes a slide frame or plate 50 which has an elongated track or guide slot 52 located therein. The plate 50 is external to the shells and is attached by four rivets 54 to the vamp shell 12, with the vertical slot 52 being aligned with an elongated vertical depression or pocket 56 formed in the vamp shell. A water-tight sealer or epoxy may be placed over the rivets 54 so as to insure that the lower vamp 12 is water-tight. Alternatively, the lower vamp may have integral extending posts, which extend through the four rivet holes in the plate 50 and secure the plate tightly against the vamp by use of capturing washers or other means. The entire plate 50 is covered by the overlapping lower region 40 of upper shell 10.

Slidable within the elongated slot 52 is a pivot pin consisting of a reduced diameter neck 60 attached to an enlarged head 62 which is captured between the plate 50 and the shell pocket 56. The pivot pin neck 60 extends through or is journalled within a circular bore 64 located in the upper shell 10 in the general vicinity of the wearer's ankle. A retaining ring 66 is snapped into an annular groove in the neck 60 so as to capture the upper shell 10 for rotatable movement about the axis of the pivot pin. The neck 60 has a hollow axial bore which receives a plastic button insert 68 which covers the retaining ring 66 to improve visual appearance while providing some protection against mud and dirt.

The slot plate 50 and pivot pin 60, 62 allow vertical motion of each side of the upper shell 10, thereby allowing a rocking sideways motion of the lower foot relative to the lower leg. Since the circular bore 64 in the upper shell is only slightly larger than the diameter of the pivot neck 60, very little foreign matter can enter from the side and jam the pivot assembly. Although mud can enter from the bottom, a motorcycle rider can clean the boot by allowing his foot to be submerged in water. If less rocking motion is desired, only one assembly 14 need be provided, with the opposite side of the upper being interconnected by a simple pivot pin fixedly secured to the vamp shell.

Vamp shell 12 is integrally molded as a single piece. The material may be polyurethane having a Shore D-60 durometer hardness. As seen in FIG. 5, a steel plate 70 is embedded in the base 72 of the vamp, beneath the instep arch of the wearer's foot. The metal plate 70 prevents the spiked peg of the motorcycle from chewing through the base 72. On the upper toe section of the vamp, cross-hatch recesses 74 are formed to weaken the vamp in this region in order to provide "feel" and a non-slip gripping area for the motorcycle shift lever. The depth of the recesses 74 are selected to allow some flex to the inboard toe region.

The replaceable sole 16 covers the entire vamp base 72 and sides, and the front toe region. The soft replaceable sole 16 is formed of a relatively flexible, rubber-like material which is also abrasion resistant, such as polyurethane having a Shore A-90 durometer hardness. The sole is molded with cross-hatch indentations 78 in the instep area, immediately under the steel plate 70, to provide a non-slip surface for the motorcycle peg. The lip of the sole has around its edge a bead 80 which is snugly received within a groove 82 which is formed in and encircles the vamp shell 12. A waterproof, rupturable seal is formed by a solvent based contact cement or adhesive, such as Nitrile-Phenolic solvent cement, which coats the entire sole 16 including the bead 80 and surrounding area, so as to semi-permanently attach the sole to the vamp. After the sole has worn sufficiently, a solvent is applied to allow the sole to be pried loose from the vamp, after which a new sole is sealed by the same type of solvent based contact adhesive. The useful life of the boot is thus greatly increased because the high wear sole is replaceable.

The interior of the vamp 12 is custom-fitted for a wearer's foot by inserting different thickness flexible liners 86 which are similar to the insert liners used for some ski boots. A wedge (not illustrated) of semi-resilient material is placed along the bottom of the vamp to form a support for the bottom of the foot. The flexibility of the liners is selected to allow the liners to be pulled out through the cylinderial upper liner 18 of the boot. Other types of foot fitting methods can be utilized, if desired.

In FIGS. 7 and 8, alternate embodiments of the interconnecting hinge assembly are illustrated. Similar components have been identified with similar reference numerals, followed by a prime or double prime. In FIG. 7, a pair of slot plates 50' are provided, with the elongated slots 52' being arcuate. The center of the two arcs 52' corresponds to the pivot point for the upper shell. The vamp 12 has arcuate pockets molded therein which capture the enlarged heads 62' of the pair of pivot pins. The reduced diameter necks 50' of the pivot pins extend through the arcuate slots and then through circular bores in the upper shell. The interconnection assembly of FIG. 7 provides good pivoting or hinging action of the upper shell while allowing some sideways rockable motion. However, the assembly is corresponding more expensive than the prior described hinge assembly 14.

In place of an elongated vertical slot, as seen in FIG. 8, circular opening 86 of greater diameter than the diameter of the neck 60 may be provided. The diameter of the enlarged head 62" is greater than the diameter of the opening 86. In this embodiment, the pivot pin is free floating and has no fixed pivot point.

Various other modifications can be made following the above teachings.

We claim:

1. A hinged boot comprising:

a vamp shell having an upper portion defining a foot receiving opening with a plurality of extending front fingers and a plurality of extending rear fingers, each of the extending fingers being deflectable, an upper shell formed of a generally rigid material and having a lower region which overlaps generally the entire upper portion of the vamp shell, the lower region having front and rear inner surfaces respectively adjacent the plurality of front and rear fingers, and hinge means interconnecting the lower region of the upper shell to the vamp shell to cause the inner surfaces of the upper shell to deflect the plurality of extending fingers as the upper shell is pivoted forwardly and rearwardly.

2. The boot of claim 1 wherein the vamp shell is formed of a generally rigid material and the plurality of extending fingers are molded integral with the vamp shell, each of the plurality of fingers having a tapering width to allow the fingers to be relatively compressed together by the inner surface of the upper shell.

3. The boot of claim 2 wherein the plurality of extending fingers with tapering width are a homolosine projection of a spherical segment onto a surface so that compression by the upper shell tends to create a generally solid spherical segment.

4. The boot of claim 2 wherein the plurality of extending fingers have an outward curvature so as to press against the inner surface of the upper shell.

5. The boot of claim 1 including an inner liner of generally cylindrical shape extending through the upper shell, the bottom of the inner liner being attached to the vamp shell below the plurality of fingers.

6. The boot of claim 5 wherein the top of the inner liner extends beyond the top of the upper shell and has attachment means therein, and the top of the upper shell has an encircling attachment means for detachable connection with attachment means of the inner liner when folded down over the top of the upper shell.

7. The boot of claim 1 wherein the upper shell is formed from a generally flat sheet of plastic material which is wrapped around to form a cylinder having overlapping side edges which can move to change the diameter of the cylinder, and strap means for securing the overlapping side edges to prevent an increase in the diameter of the cylinder.

8. A hinged boot comprising:

a vamp shell having an attachment section, an upper shell having an attachment section which overlaps the vamp attachment section, hinge means protected from external adverse conditions for interconnecting the attachment sections to allow pivoting forward and rearward movement and sideways rocking movement of the upper shell relative to the vamp shell, the protected hinge means including a slide frame located between the vamp section and the upper section, the frame having a slide aperture, a pivot pin having an enlarged head of greater cross-section than the slide aperture and an extending neck of smaller cross-section than the slide aperture and extending therethrough, means connecting the slide frame to one of the attachment sections with the overlapping upper shell extending down over and covering the slide frame, and means connecting the pivot pin to the other of the attachment sections.

9. The boot of claim 8 wherein the attachment section of the upper shell has a circular aperture which receives the neck of the pivot pin in order to form a pivot axis for the upper shell.

10. The boot of claim 9 wherein the neck of the pivot pin has a recessed groove which holds a retaining ring to caputre the upper shell between the slide frame and the retaining ring.

11. A hinged boot comprising:

an upper shell formed of a relatively rigid plastic material, a vamp shell formed of a relatively rigid plastic material, hinge means interconnecting the upper shell to the vamp shell for pivotal forward and rearward movement of the upper shell, a replaceable sole formed of a relatively resilient material and having a base with a surrounding lip, and adhesive means forming a rupturable seal for connecting at least the lip of the replaceable sole to the vamp shell.

12. The boot of claim 11 wherein the vamp shell has a recessed groove in at least a portion of the toe region of the vamp, and the lip of the replaceable sole has a bead which is snugly received in the recessed groove.

13. The boot of claim 11 wherein the base of the vamp shell adjacent the instep area has a metal plate embedded therein.

14. The boot of claim 11 wherein the vamp shell has at the toe region a plurality of recessed grooves which weaken the rigid shell sufficiently to allow limited flexing of the weakened toe region.

15. The boot of claim 11 wherein the adhesive means is a solvent based contact cement which is soluble to allow replacement of the sole.

16. A hinged boot comprising:

a vamp shell having an attachment section, an upper shell having an attachment section, one of the attachment sections having an elongated depression therein of a length greater than its width, a slide frame fixedly attached to said one of the attachment sections and having an elongated slot aligned with the elongated depression so that the length of the elongated slot is parallel with the length of the elongated depression, a pivot pin having an enlarged head slidably captured by the frame within the elongated depression and a reduced neck extending through the elongated slot to allow the pivot pin to move longitudinally within the elongated slot, and means connecting the neck of the pivot pin to the other of the attachment sections to allow pivoting forward and rearward movement and sideways rocking movement of the upper shell relative to the vamp shell.

17. The hinged boot of claim 16 wherein the vamp shell is integrally molded with the elongated depression formed as a pocket therein, and the attachment section of the upper shell comprises an aperture through which the neck of the pivot pin extends with a portion of the upper shell extending down over the slide frame so that the upper shell entirely overlaps and covers the elongated slot.

18. A hinged boot comprising:

a vamp shell having an attachment section, an upper shell having an attachment section, hinge means interconnecting the attachment sections to allow pivoting forward and rearward movement and sideways rocking movement of the shells, including a pivot pin connected to one of the attachment sections and having an enlarged head and a neck of smaller cross-section extending therefrom, and a slide frame fixedly attached to the other of the attachment section and having a slide aperture of greater extent in all directions than the cross-section of the extending neck and of lesser extent in at least one direction than the extent of the enlarged head to cause the pivot pin to float in the slide frame and have no fixed axis.

19. A hinged boot comprising:

a vamp shell having a foot receiving opening defined by a forward flap and a rear flap, the forward and rear flaps each being deflectable and being spaced apart at the sides of the vamp shell by a region devoid of material, an upper shell formed of a generally rigid material and having a lower region which overlaps generally the entire forward and rear flaps and an upper portion of the sides of the shell to prevent penetration of the shells by airborne objects, and hinge means pivotally interconnecting the upper and vamp shells to allow at least pivoting forward and rearward movement of the upper shell which deflects the flaps.

20. The hinged boot of claim 19 wherein each of the forward and rear flaps is formed by a plurality of elongated extensions which resiliently yield so as to allow essentially free pivoting action of the shell when the plurality of extensions are compressed.

21. The hinged boot of claim 19 wherein the hinge means includes a slide frame fixedly attached to one of the shells and having an elongated slide aperture located therein, a pivot pin having an enlarged head slidably captured by the slide aperture and a neck of smaller cross-section extending through the slide aperture, the neck being attached to the other of the shells to allow pivoting forward and rearward movement which deflects the flaps and sideways rocking movement of the upper shell relative to the vamp shell.

22. The hinged boot of claim 19 including a replaceable sole having indentations in the instep area of the bottom of the vamp shell, and means for replaceably attaching the sole to the vamp shell.

23. The hinged boot of claim 19 wherein the vamp shell has on its upper toe section a nonslip gripping area.

* * * * *